US007798362B1

(12) United States Patent
Chang

(10) Patent No.: US 7,798,362 B1
(45) Date of Patent: Sep. 21, 2010

(54) MERCHANDISE HOLD DOWN MECHANISM FOR A VENDING MACHINE

(76) Inventor: Kil Jae Chang, T.PICo. Korea Co., Ltd., 321-37 Suksu, 2 Dong, Anyang City, Kyungkido (KR)

( * ) Notice: Subject to any disclaimer, the term of this patent is extended or adjusted under 35 U.S.C. 154(b) by 360 days.

(21) Appl. No.: 12/009,707

(22) Filed: Jan. 22, 2008

Related U.S. Application Data

(60) Provisional application No. 60/936,051, filed on Jun. 18, 2007.

(51) Int. Cl.
*G07F 9/00* (2006.01)

(52) U.S. Cl. ..... 221/279

(58) Field of Classification Search ..... 221/69, 221/89, 91, 112–115, 123–127, 132–134, 221/152, 208, 227, 244, 268, 270–272, 275, 221/277, 279, 312 A, 312 R
See application file for complete search history.

(56) References Cited

U.S. PATENT DOCUMENTS

| | | | | | |
|---|---|---|---|---|---|
| 251,296 | A | * | 12/1881 | Rushforth | 312/61 |
| 340,355 | A | * | 4/1886 | Ramser | 221/59 |
| 892,687 | A | * | 7/1908 | Schrum | 221/122 |
| 1,169,775 | A | * | 2/1916 | Cornwall | 53/305 |
| 1,466,372 | A | | 8/1923 | Giles | |
| 1,517,377 | A | * | 12/1924 | Mortensen | 194/296 |
| 1,697,510 | A | | 1/1929 | Morin | |
| 1,754,527 | A | * | 4/1930 | Rowe | 312/321.5 |
| 2,784,872 | A | * | 3/1957 | Lux | 221/207 |
| 2,990,084 | A | | 6/1961 | Probasco | |
| 3,270,915 | A | * | 9/1966 | Auer | 221/2 |
| 3,734,344 | A | * | 5/1973 | Teichelman | 221/14 |
| 4,109,825 | A | | 8/1978 | Weitzman | |
| 5,261,564 | A | | 11/1993 | Yelvington | |
| 5,472,074 | A | | 12/1995 | Milcetic | |
| 5,829,631 | A | * | 11/1998 | Kasper | 221/198 |
| 2005/0077311 | A1 | * | 4/2005 | Chang | 221/121 |

* cited by examiner

*Primary Examiner*—Gene Crawford
*Assistant Examiner*—Kelvin L Randall, Jr.
(74) *Attorney, Agent, or Firm*—John R. Flanagan

(57) ABSTRACT

A hold down mechanism includes a shaft, ring-shaped member, latch device fixed to the member and latchable with teeth thereon to permit unassisted movement of the member and latch device downward along the shaft due to the influence of gravity on the member but not upwardly along the shaft by manually lifting the member without unlatching the latch device from the shaft, support arms fixedly spaced apart on and extending inwardly from the member, platens independently reciprocally mounted below support arms, and a spring mounted between platens and support arms exerting a weak downward force on platens independently so as to bias platens to move downwardly away from support arms and against items in stacks aligned under platens while at the same time yieldable to permit platens to move upwardly toward support arms to accommodate differences in stack heights as items are successively dispensed therefrom. Optionally, the mechanism may be used without the shaft.

17 Claims, 6 Drawing Sheets

MERCHANDISE HOLD DOWN MECHANISM FOR A VENDING MACHINE

This patent application claims the benefit of U.S. provisional application No. 60/936,051 filed Jun. 18, 2007.

BACKGROUND OF THE INVENTION

The present invention generally relates to vending machines and, more particularly, is concerned with a merchandise hold down mechanism for a vending machine.

One general type of prior art vending machine, that has been manufactured and sold heretofore by the inventor herein, includes a merchandise storage and dispensing head, a housing supporting the head, and a coin-operated actuation mechanism mounted on and extending into the interior of the housing to where the actuation mechanism operably engages a dispensing wheel on the bottom of the head and rotates it to dispense items of product via a delivery chute to an external location on the housing in response to deposit of a coin by a user into the actuation mechanism and turning of a handle of the actuation mechanism by the user. The vending machine also has a coin box disposed in a base of the housing below the actuation mechanism and dispensing wheel for receiving the coin from the operation of the actuation mechanism that was deposited into the actuation mechanism by the user.

In one particular version of this prior art vending machine, the merchandise storage and dispensing head includes a rotary carousel with a merchandise holding magazine formed by a plurality of product stacking tubular receptacles or columns arranged in a circular row and mounted on a circular bottom plate of the carousel. Items of product are dispensed from the lowermost end of the stacks thereof in the columns through the bottom plate when the carousel is rotated so as to bring each of the columns successively into aligned over a dispensing opening in a stationary platform below the carousel which is mounted on the upper end of the housing. The dispensing wheel is located below the stationary platform but fixedly coupled to the bottom plate of the carousel and drivingly engaged by the actuation mechanism so as to rotate and carry with it the carousel in response to the user depositing a coin in the actuation mechanism and turning a handle thereon.

This particular vending machine has been subjected to abuse by vandals who attempt to steal items from the machine by inverting and shaking it so as to attempt to dislodge the items stacked in the columns. They try to scatter these items from their stacked and confined locations in the columns so that some might find their way through the dispensing opening in the stationary platform and through the dispensing wheel into the discharge chute without the depositing any coins in the actuation mechanism and turning the actuating handle of the mechanism. Most of these attempts to pilfer items from the machine in this manner end in failure but do oftentimes result either in damage to the machine or render the machine out of operative condition until serviced by the owner. This results in a loss of opportunity for the machine to earn revenue for its owner.

Consequently, a need exists for an innovation that will solve the aforementioned problem in the art without introducing any new problem in place thereof.

SUMMARY OF THE INVENTION

The present invention provides a merchandise hold down mechanism designed to satisfy the aforementioned need. The merchandise hold down mechanism of the present invention has a ring-supported plurality of platens adapted to exert weight or force upon stacks of items thereunder to maintain the items in the stacked conditions. In addition, for many applications the mechanism also includes the use of an upright shaft to which a ring supporting the platens is latched. The ring has a latch device adapting the ring and the platens supported thereon to self-adjust the latched position on the shaft by undergoing downward descend along the shaft while the platens maintain engagement with stacks of items as the number of dispensed items decrease the heights of the stacks. At the same time, the hold down mechanism without first being positively unlatched from the shaft cannot be lifted or dislodged upwardly from its self-adjusted latched position on the shaft, thereby preventing dislocation of items in the vending machine by inverting and shaking the vending machine. Optionally, the mechanism can be employed without the shaft.

Accordingly, the present invention is directed to a merchandise hold down mechanism which includes: (a) a ring-shaped member; (b) a plurality of support arms equally spaced apart from one another and fixed to and extending inwardly from the ring-shaped member; and (c) a plurality of platens each mounted on and disposed below one of said support arms so as to impose a predetermined amount of weight on a stack of items therebelow. Also, the platens can be provided so as to be each independently of one another movably and reciprocally mounted on and disposed below one of the support arms. Further, the mechanism comprises a mechanically acting element made of yieldably resilient material mounted between the platens and the support arms for exerting a relatively weak downwardly directed force on each of the platens independently of other of the platens so as to bias a respective one of the platens to move downwardly away from a corresponding respective one of the support arms and against a top one of a plurality of items in a corresponding one of a plurality of stacks aligned with and under the plurality of platens while at the same time the element being yieldable to permit the platen to move upwardly toward the support arm to accommodate the stacks of items having different heights as items are successively dispensed from bottoms of successive stacks.

Still further, the mechanism comprises an elongated upright shaft having a series of vertically spaced and outwardly projecting teeth defined thereon between lower and upper ends of the shaft. The mechanism also comprises a latch device is fixedly cantilevered to the ring-shaped member and latchable to the upright shaft in cooperation with the teeth thereon so as to permit unassisted movement of the ring-shaped member and the latch device therewith downward along the shaft due to the influence of gravity on the ring-shaped member but not upwardly along the shaft due to manually lifting the ring-shaped member without first unlatching the latch device from the shaft.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
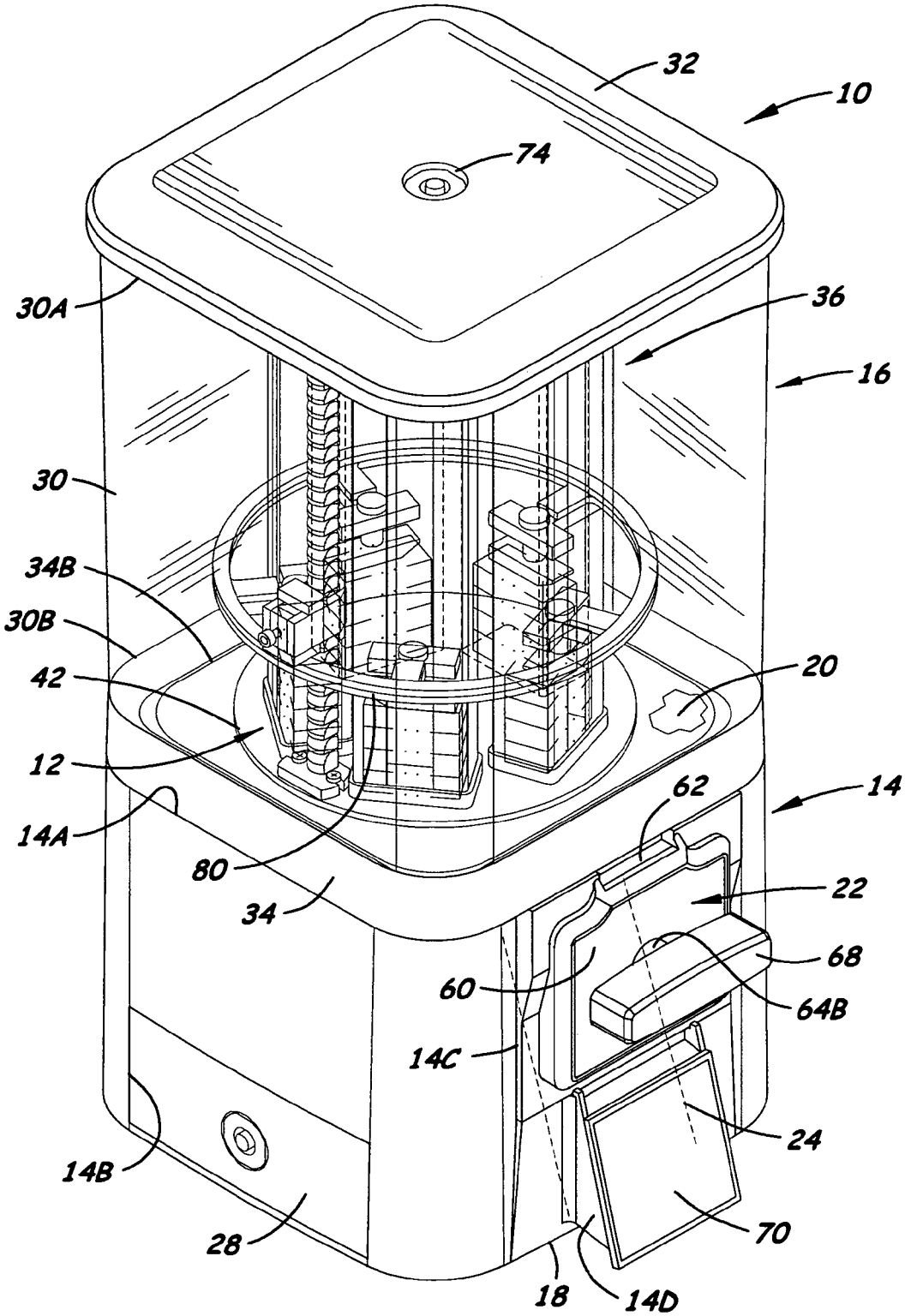
FIG. 1 is a perspective view of a vending machine in which is installed a merchandise hold down mechanism of the present invention.
Figure 2:
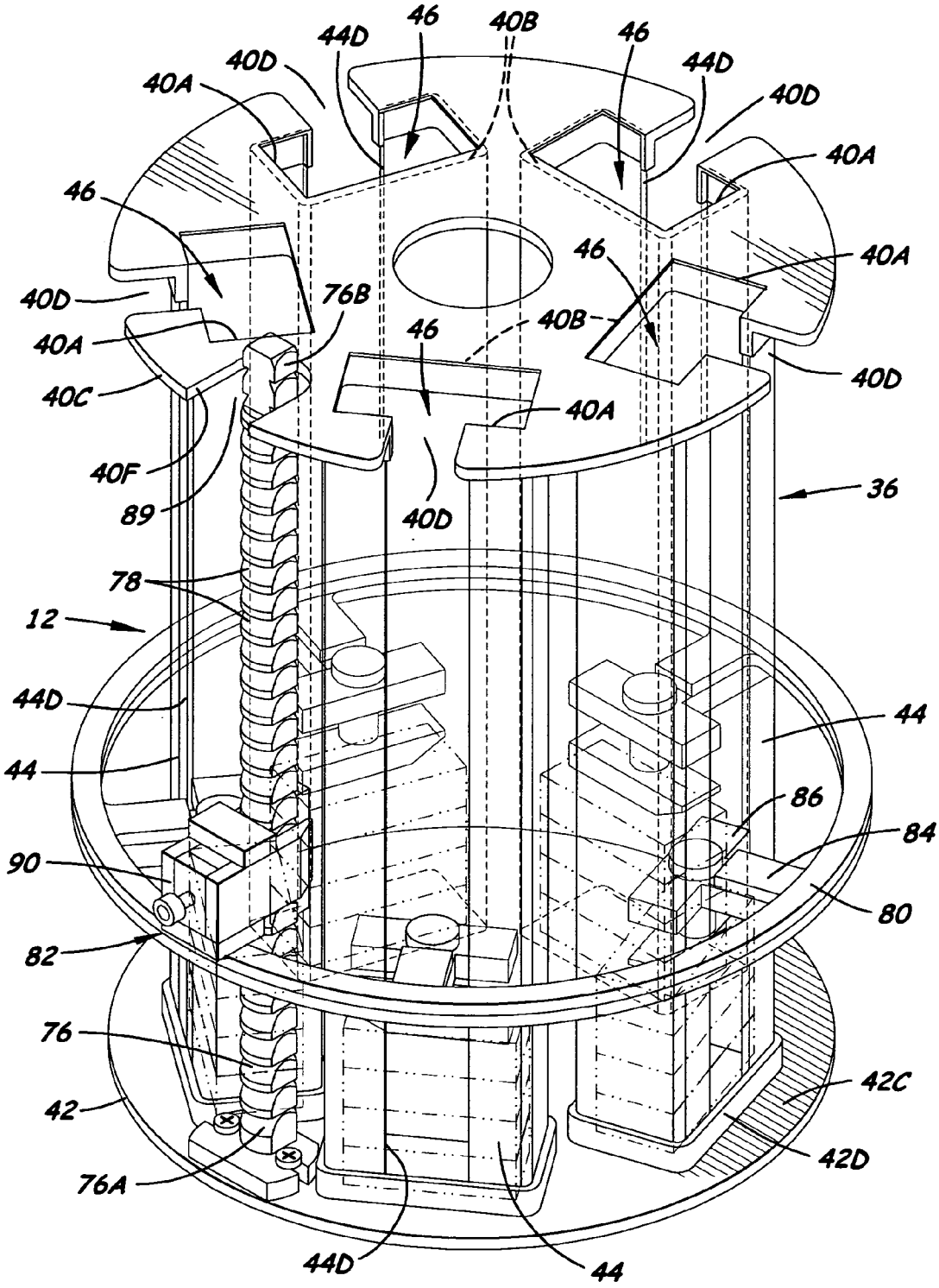
FIG. 2 is an enlarged perspective view of a merchandise carousel removed from the machine of FIG. 1 to better illustrate the installation therein of the hold down mechanism of the present invention.
Figure 3:
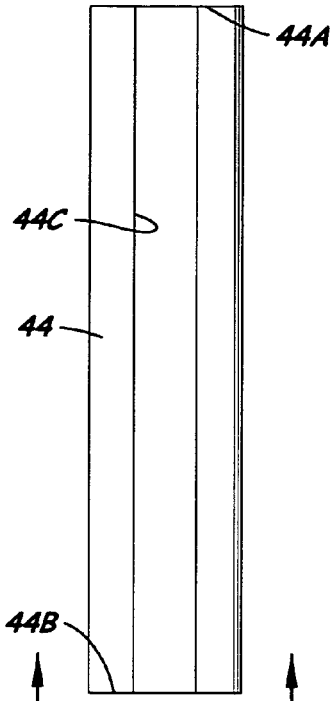
FIG. 3 is an enlarged elevational view of one of the storage columns of the carousel of FIG. 2 which has an overall rectangular configuration.
Figure 5:
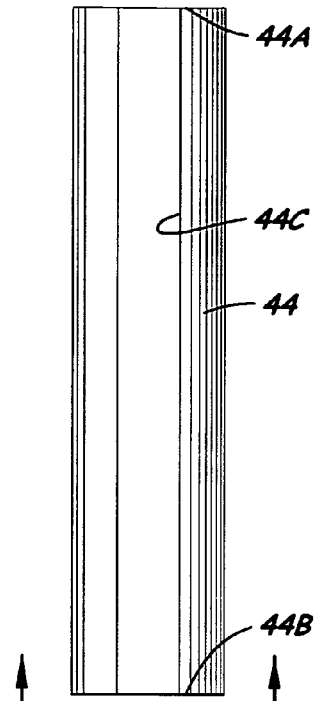
FIG. 5 is an elevational view similar to that of FIG. 3 but of an alternative storage column having an overall cylindrical configuration.
Figure 4:
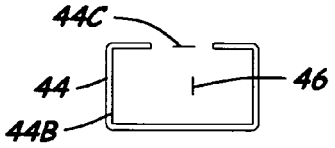
FIG. 4 is a bottom view of the storage column as seen along line 4-4 of FIG. 3 to illustrate the rectangular configuration of the storage column.
Figure 6:
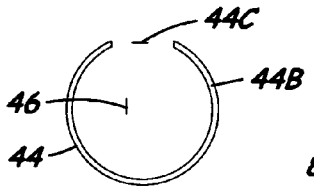
FIG. 6 is a bottom view of the storage column as seen along line 6-6 of FIG. 5 to illustrate the cylindrical configuration of the storage column.
Figure 8:
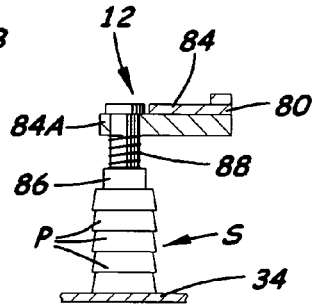
FIG. 8 is an enlarged fragmentary vertical sectional view of the hold down mechanism taken along line 8-8 of FIG. 7.
Figure 7:
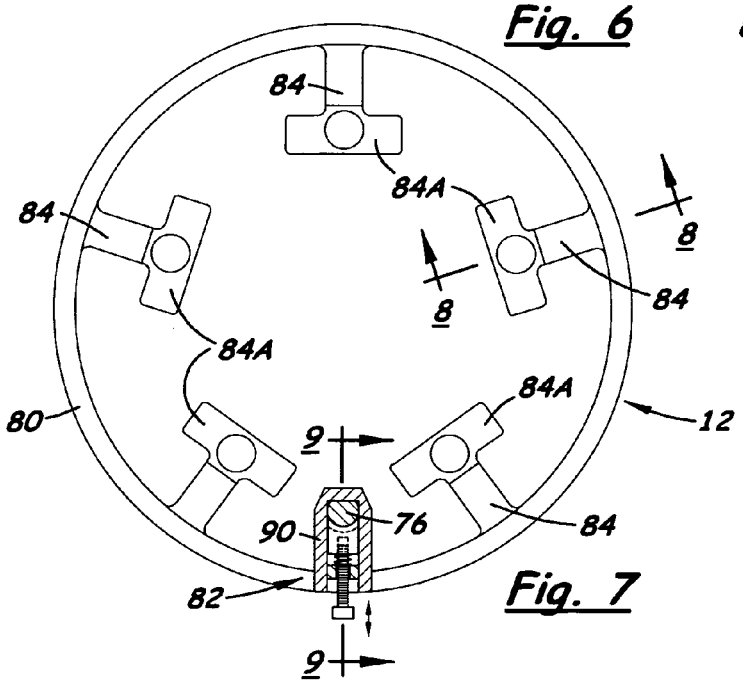
FIG. 7 is an enlarged top plan view of the hold down mechanism of the present invention removed from the merchandise carousel of FIG. 2.

Referring to the drawings and particularly to FIG. 1, there is illustrated a coin-operated vending machine, generally designated 10, incorporating a merchandise hold down mechanism of the present invention, generally designated 12. Basically, the vending machine 10 includes a housing 14 and a merchandise storage and dispensing head 16 supported upon the housing 14. The housing 14 preferably, but not necessarily, is rectangular in configuration and has an open top end 14A, a closed bottom 18 and an interior chamber 20 extending therebetween. The vending machine 10 also includes a coin-operated actuation mechanism 22 and a discharge chute 24 supported by the housing 14, an elongated assembly rod 26 (see FIG. 13) extending vertically through the interior chamber 20 of the housing 14 and interconnecting and locking the housing 14 and head 16 together, and a lockable coin box 28 disposed in the interior chamber 20 of the housing 14 upon the closed bottom 18 thereof and when unlocked removable through a side opening 14B in the housing 14.

Figure 12:
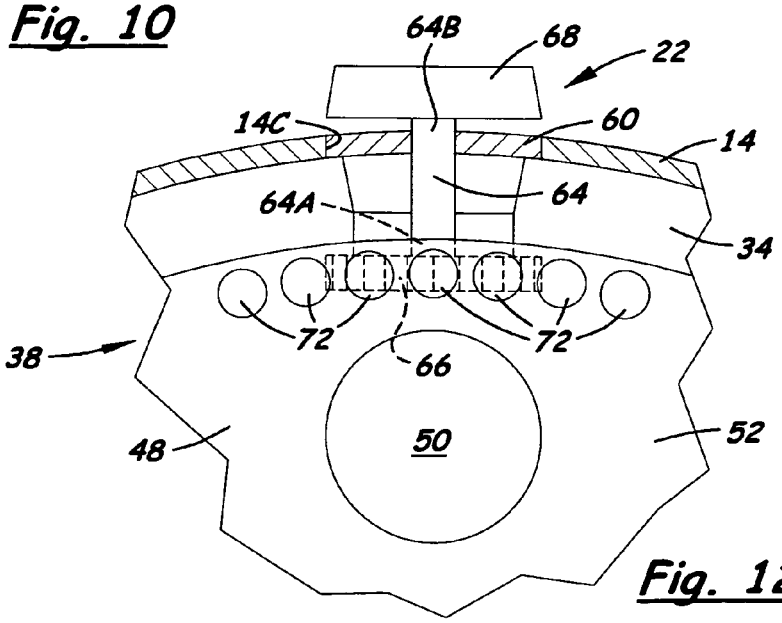
FIG. 12 is an enlarged bottom plan view taken along line 12-12 of FIG. 11 to show a drive gear of a coin-operated actuation mechanism intermeshed with the dispensing wheel of the machine.

The merchandise storage and dispensing head 16 of the vending machine 10 includes an outer transparent enclosure 30 preferably, but not necessarily, rectangular in overall configuration, a removable cap 32 fittable upon an open upper end 30A of the enclosure 30 to close the same, and a top cover or platform 34 removably supported on the open top end 14A of the housing 14 to close the same. The platform 34 removably seats and closes the outer enclosure 30 at its lower open end 30B within an interior peripheral recess 34A formed in the platform 34. The head 16 of the vending machine 10 also includes a generally cylindrical-shaped magazine or carousel 36 disposed in the outer transparent enclosure 30, below the removable cap 32 and above the platform 34, and a dispensing mechanism 34, as seen in FIGS. 11-13, disposed below the platform 34 and fastened to the carousel 36 via a central boss 34B defined in the platform 34.

Referring now to FIGS. 1-5, 11 and 12, the carousel 36 of the head 14 includes upper and lower plates 40, 42 and a plurality of elongated tubular storage receptacles or columns 44 defining product receiving and stacking compartments 46 therein. The storage columns 44 are mounted upright in relation to, and extend between, the upper and lower plates 40, 42. The storage columns 44 are displaced angularly from each other in a substantially endless circular arrangement or row. As can be understood with respect to two exemplary forms of the carousel 36 shown in FIGS. 3-4 and 5-6 of the drawings, the columns 44 and their respective compartments 46 can have rectangular or circular cross-sectional configurations for accommodating and holding therein a stack S of products or items P, such as flat mints or the like, being correspondingly rectangular or circular in configuration. The compartments 46 of the storage columns 44 open at the tops and bottoms 44A, 44B of the columns 44. The columns 44 also have elongated slots 44C defined in outwardly facing side portions of the columns 44, opening into the compartments 46 and extending lengthwise between and opening at the open tops and bottoms 44A, 44B of the columns 44. The upper and lower plates 40, 42 have respective pluralities of holes 40A, 42A defined therethrough, rims 40B, 42B formed on facing surfaces 40C, 42C of the plates 40, 42 and outwardly-facing slots 40D defined in the upper plate 40 and rims 40B. The holes 40A, 42A with their associated rims 40B, 42B are angularly displaced from one another and of a size and arrangement matching that of the open tops and bottoms 44A, 44B of the storage columns 44 such that the opposite open tops and bottoms 44A, 44B of the storage columns 44 tightly interfit with the rims 40B, 42B of the upper and lower plates 40, 42. The holes 40A, rims 40B and slots 40D of the upper plate 40 together with the open tops 44A of the storage columns 44 facilitate by use of one's hand, and thus manually, placing and stacking of the items P in the storage columns 44, whereas the open bottom 44B of the storage columns 44 facilitate resting the stacks S upon a top surface 34C of the platform 34 and successive discharging of such items P one at a time from the bottom of the stacks S from the storage columns 44 through a dispensing passage 34D in the platform 34, as will be described below.

Figure 11:
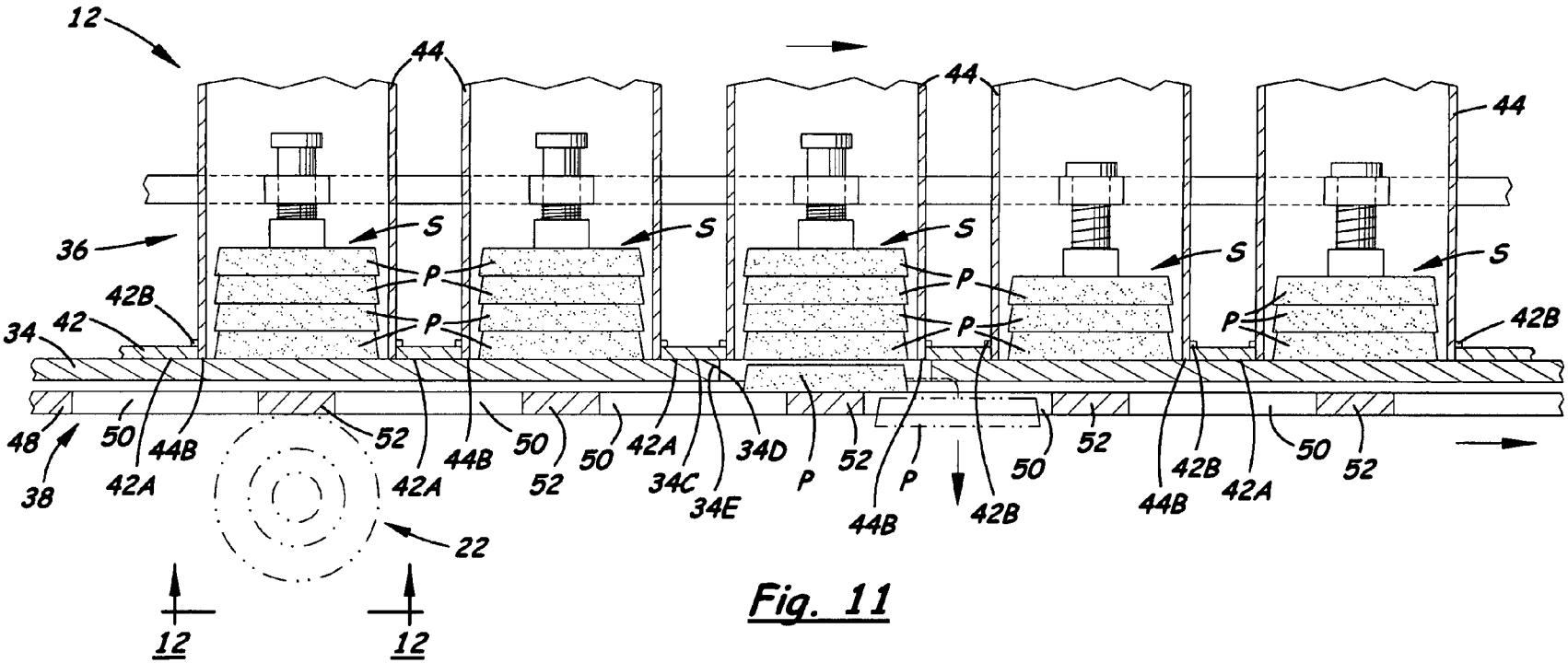
FIG. 11 is an enlarged sectional view of the hold down mechanism in a linear layout arrangement along a vertical sectional plane through the hold down mechanism with the mechanism installed on storage columns of the carousel above a stationary platform of the machine and above a dispensing wheel of the machine located immediately below the machine platform with which the carousel moves relative to the machine platform to show the relative positions of platens of the hold down mechanism on stacks of items of different heights and to show the dispensing of one of the items through the machine platform of the carousel and the dispensing wheel.
Figure 13:
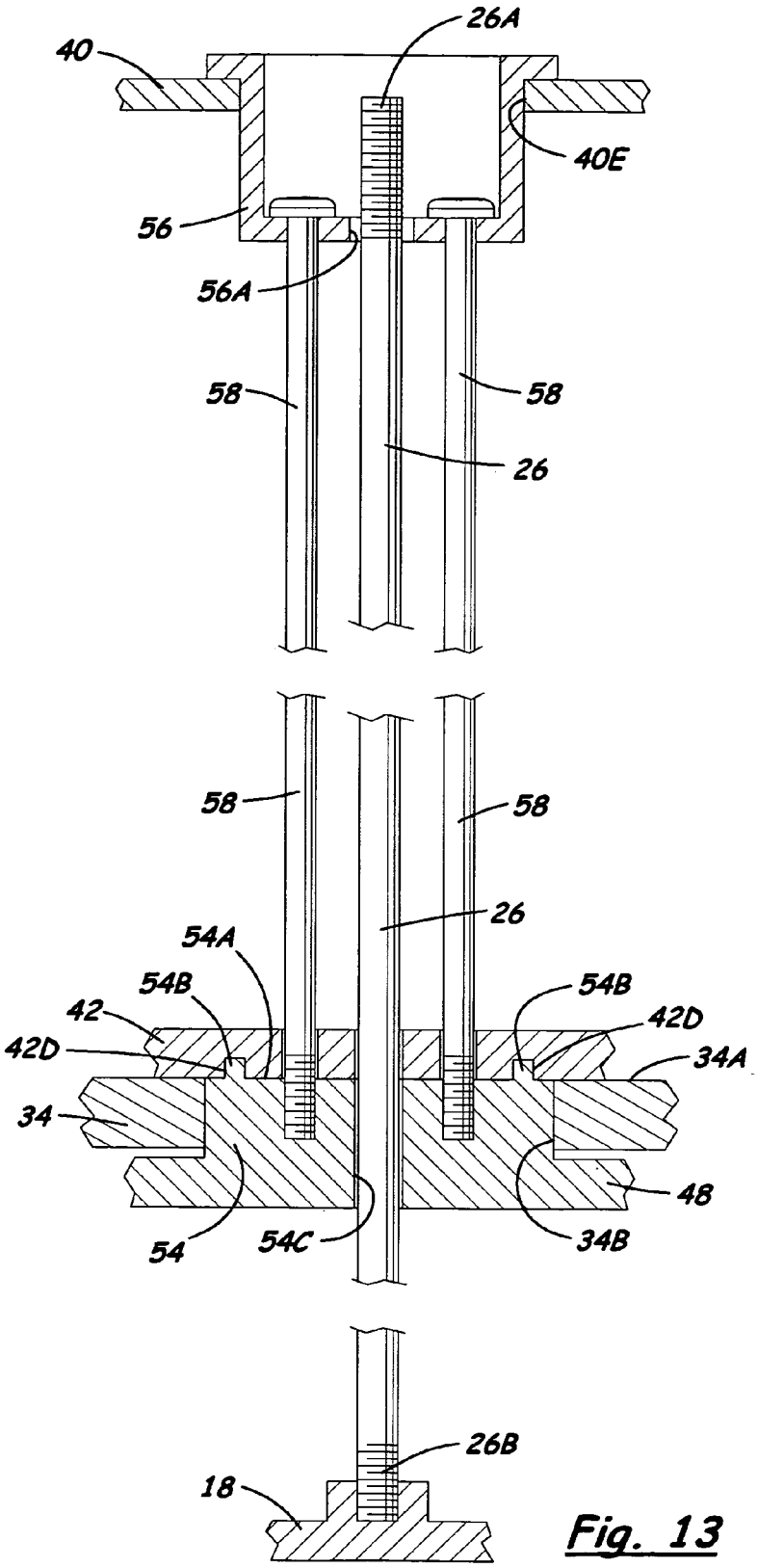
FIG. 13 is an enlarged fragmentary foreshortened view of components of the machine which fixedly secure the carousel upon the dispensing wheel.

As seen in FIGS. 11 and 13, the dispensing mechanism 38 of the head 14 includes a dispensing wheel 48 of a generally circular configuration. The dispensing wheel 48 has a plurality of large circular dispensing openings 50 formed therein and angularly spaced from one another about the dispensing wheel 48. The dispensing wheel 48 also has a plurality of solid spacer portions 52 disposed between the openings 50 such that the openings 50 and spacer portions 52 alternate with one another in an endless circular row. As seen in FIG. 11, which shows the circular row of columns 44 of the carousel 36 and the circular row of alternating openings 50 and spacers 52 of the dispensing wheel 48 in a linear layout arrangement for illustrative purposes, the dispensing wheel 48 of the dispensing mechanism 38 is located below the platform 34 and the carousel 36 is located above the platform 34. As seen in FIG. 13, the dispensing wheel 48 and the lower plate 42 of the carousel 36 are fixedly interconnected to one another at central locations thereon by a centrally-located lower cylindrical connector 54 which is formed on the dispensing wheel 48 and projects upwardly through the central boss 34A in the platform 34, a centrally-located upper cylindrical connector 56 seated through a central opening 40E in the upper plate 40 of the carousel 36 and a pair of tie rods 58 which are inserted through the upper connector 56 and fastened to the lower connector 54 so as to clamp the carousel 36 upon a top surface 54A of the lower connector 54 and thus, in effect, upon the dispensing wheel 48. There is also provided a plurality of upwardly projecting studs 54B on the top surface 54A of the lower connector 54 which interfit in a matching plurality of apertures 42D defined in the lower plate 42 of the carousel 36 when the lower plate 42 is resting upon the top surface 54A of the lower connector 54. The interfitting relationship of the studs 54B with the apertures 40D prevents any tendency for the carousel 36 to twist relative to the lower connector 54 upon rotation of the dispensing wheel 48 by operation of the actuation mechanism 22. In such arrangement, the carousel 36 and the dispensing wheel 48 are fastened together and rotatable in unison with one another relative to the stationary platform 34 of the head 16.

Referring again to FIG. 11, the single dispensing passage 34D of the platform 34 is defined therein at a location radially outward from the central boss 34A and overlying the endless circular row of alternating dispensing openings 50 and spacer portions 52 of the dispensing wheel 48. The platform 34 also is provided with an entrance ramp 34E at a leading end of the passage 34D (as viewed relative to the direction of rotation of the carousel 36) to facilitate separation of the lowermost ones of the items P from their respective stacks S as they slide about the top surface 32C of the platform 34 and successively move over and deposit into the dispensing passage 34D with rotation of the carousel 36. Normally one of the spacer portions 52 of the dispensing wheel 48 is disposed below and extends across the dispensing passage 34D for receiving thereon the one of the items P deposited into the passage 34D but preventing it from dropping below the passage 34D and through the one of the dispensing openings 50 immediately downstream and adjacent to the one spacer portion 52 until the dispensing wheel 48 has been moved by operation of the coin-operated actuation mechanism 22, as will be described below.

As seen in FIGS. 1 and 12, the coin-operated actuation mechanism 22 is mounted to and supported by the housing 14 so as to occupy a front slot 14C defined in the housing 14 and open at the open top 14A of the housing 14. In such position, the actuation mechanism 22 extends both within and without the housing 14. The actuation mechanism 22 includes a mounting structure 60 mounted within the front slot 14C so as to define a top coin deposit slot 62 and also include a central drive shaft 64 mounted through the mounting structure 60 for rotation about an axis extending in a generally orthogonal relation to a central axis of the head 16 which is coaxial with the elongated assembly rod 26. The actuation mechanism 22 further includes a drive gear 66 attached to an inner end 64A of the drive shaft 64 for undergoing rotation therewith. The drive gear 66 is disposed in the interior chamber 20 of the housing 14 below and intermeshed with the dispensing wheel 48, as described below, such that rotation of the drive gear 66 with the drive shaft 64 will cause rotation of the dispensing wheel 48 and carousel 36 relative to the platform 34. The actuation mechanism 22 still further includes a knob 68 attached to an other end 64B of the drive shaft 64 such that upon deposit by a user of a given coin in the top coin deposit slot 62 in the mounting structure 60 of the actuation mechanism 22 and by the user turning the knob 68 through one revolution, the drive shaft 64 and drive gear 66 are rotated and cause the dispensing wheel 48 and carousel 36 to rotate through a given dispensing cycle permitting the one item P resting on the one spacer portion 52 underlying the dispensing passage 34D to drop through the adjacent one of the dispensing openings 50 as the one spacer portion 52 moves away from the dispensing passage 34D and then a following one of the items P in the stack thereof to drop into the passage 34D onto the next successive one of the spacer portions 52 as each successive one of the columns 44 of the carousel 36 passes over the dispensing passage 34D of the platform 34. The one item P which drops through the dispensing opening 50 of the dispensing wheel 48 then drops into the discharge chute 24 and through the discharge chute 24 to a discharge outlet 14D on the housing 14. The discharge outlet 14D is covered by a pivotal door 70 by the lifting of which a user can gain access to an item P of merchandise dispensed by the operation of the vending machine 10.

While the plurality of columns 44 of the carousel 36 are the same in number, for example five, as the plurality of dispensing openings 50 of the dispensing wheel 48 and the plurality of spacer portions 52 of the dispensing wheel 48, as seen in FIG. 11 they are not vertically aligned above the respective dispensing openings 50. Instead, the columns 44 are vertically aligned above the respective spacer portions 52 of the dispensing wheel 48 such that when the given one of the columns 44 is aligned above the dispensing passage 34D through the platform 34 a corresponding one of the spacer portions 52 underlies and blocks the one of the items P from dropping completely through the dispensing passage 34D to the discharge chute 24. Thus, the one item to be dispensed is retained in the dispensing passage 34D until the columns 44 of the carousel 36 and the dispensing wheel 48 of the dispensing mechanism 38 are rotated relative to the platform 34 so as to bring a next one of the dispensing openings 50 on the dispensing wheel 48 into alignment under the dispensing passage 34D of the platform 34 to complete one dispensing cycle upon operation of the coin-operated actuation mechanism 22 after the depositing of a coin in its top coin deposit slot 62. Upon such rotation of the dispensing wheel 48 and thereby of the one spacer portion 52 from under the dispensing passage 34D the adjacent dispensing opening 50 is brought under the passage 34D such that the passage 34D is unblocked allowing the one item P in the passage 34D to drop completely through the dispensing passage 34D to the discharge chute 24. As the dispensing wheel 48 reaches the end of the dispensing cycle the next succeeding one of the spacer portions 52 is brought into the underlying relation to the dispensing passage 34D again blocking the next item P which has entered into the passage 34D from dropping completely therethrough to the discharge chute 24 but in position to do so upon the actuation of the next succeeding dispensing cycle.

As seen in FIG. 12, the dispensing wheel 48 further has a row of circumferentially spaced apart small holes 72 formed therethrough about the periphery thereof such that the drive gear 66 of the coin-operated actuation mechanism 22 drivingly intermeshes with adjacent ones of the holes 72. Then, rotation of the drive gear 66 will cause rotation of the dispensing wheel 48 and the carousel 36 therewith relative to the platform 34. Further, upon deposit by a user of a given coin in the coin actuation mechanism 22 and by the user turning the knob 68 of the actuation mechanism 22 through on revolution, the drive gear 66 is rotated and causes the dispensing wheel 48 to rotate from a desired start position through the given one dispensing cycle, for example, equal to one-fifth of a full cycle or seventy-two degrees permitting the item P to drop from the dispensing passage 34 D through one of the dispensing openings 50 in the dispensing wheel 48 and into the discharge chute 24, as described above.

As seen in FIG. 13, the assembly rod 26 is extendible through the head 16 (and thus through central holes 54C, 56A through the lower and upper connectors 54, 56 respectively of the dispensing mechanism 38 and the carousel 36) and the housing 14 and connectible at respective lower and upper ends 26A, 26B to the housing 14 and the removable cap 32 for lockably interconnecting them together with the remainder of the head 16 clamped therebetween. Thus, the assembly rod 26 holds the vending machine 10 in an assembled condition but permits its disassembly and the removal of the carousel 36 and the dispensing mechanism 38 of the head 16 and the platform 34 therewith, as a unit, from the housing 14. The assembly rod 26 is attached at its lower end 26A to the closed bottom 18 of the housing 14 and extends upwardly through the housing 14, lower connector 54 to the dispensing wheel 48, platform 34, upper connector 56 of the carousel 36, and removable cap 32 to the upper end 26A of the assembly rod 26. The upper end 26A can be lockably secured by a lock mechanism 74 for assembling and clamping the enclosure 30 and platform 34 of the head 16 between the housing 14 and the cap 32 with the carousel 36 rotatably mounted on the platform 34 and drivingly meshed with the drive gear 66 of the actuation mechanism 22.

All components of the vending machine 10 (except for the hold down mechanism 12) which have been described up to this point are well-known in the prior art.

Turning now to FIGS. 2 and 7-10, the merchandise hold down mechanism 12 of the present invention preferably, but not necessarily, includes an elongated upright shaft 76 with a series of vertically-spaced and outwardly-projecting ratchet teeth 78 defined thereon between the lower and upper ends 76A, 76B of the shaft 76. The mechanism 12 also includes a ring-shaped structure or member 80 and a latch device 82 fixedly cantilevered to the ring-shaped member 80 and latchable to the upright shaft 76. The mechanism 12 further includes a plurality of support arms 84 equally spaced apart from one another and fixed to and extending inwardly from the ring-shaped member 80, and a plurality of platens 86 each independently movably and reciprocally mounted on and disposed below one of the support arms 84 for exerting a relatively weak downwardly-directed force on the platens 86. Each of the coiled springs 88 biases a respective one of the platens 86 to move downwardly away from the respective one of the support arms 84 and against the top one of the items P in a corresponding one of the stacks S while being yieldable to permit the platen 86 to move upwardly toward the support arm 84 to accommodate the situation where the stacks S of items P have different heights as the items P are successively dispensed from the bottoms of the successive stacks S, as seen in FIG. 11.

More particularly, the upright shaft 76 of the hold down mechanism 12 is fixedly fastened at its lower end 76A upon the lower plate 42 of the carousel 36 and extends upwardly therefrom to its upper end 76B which extends through a notch 40F defined in the upper plate 40 of the carousel 36 such that the edges of the upper plate 40 forming the notch 40F are spaced from the upright shaft 76 so as to define a gap 89 therebetween partially surrounding the shaft 76. The upright shaft 76 also extends generally parallel and adjacent to one pair of, the plurality of storage columns 44 of the carousel 36. Each of the ratchet teeth 78 on the upright shaft 76 is defined by a downwardly and outwardly sloping upper surface 78A which merges with an outer arcuate-shaped vertically-extending middle surface 78B which, in turn, merges with a radially horizontally extending lower surface 78C which is generally orthogonal to the vertical axis of the upright shaft 76. The downwardly and outwardly sloping upper surfaces 78A of the ratchet teeth 78 on the shaft 76 serve as cam surfaces whereas the radial horizontal lower surfaces 78C serve as stopping or blocking surfaces, as will become clear below.

The ring-shaped member 80 of the hold down mechanism 12 is manually placeable over and outside of the storage columns 44 of the carousel 36 which are arranged in the circular row thereof and over and outside of the upright shaft 76. In such placement, the ring-shaped member 80 is spaced outwardly from and extends about the storage columns 44 and the upright shaft 76. The support arms 84 of the hold down mechanism 12 match in number the plurality of columns 44 of the carousel 36 and are spaced from one another about, and fixedly connected in a cantilevered arrangement to, the ring-shaped member 80 such that each support arm 84 projects inwardly from the ring-shaped member 80 and extends through the exteriorly facing lengthwise slots 40D of the respective columns 44 of the carousel 36. The platens 86 match in number the plurality of support arms 84 with each platen 86 being reciprocally supported by, and disposed below, an inner end 84A of one support arm within the compartment 46 of the respective one of the columns 44 of the carousel 36. The resilient coiled springs 88 surround a shaft 86A affixed on and extending upwardly from the respective platens 86 and movable through openings 84B in inner end portions 84C of the support arms 84 such that the springs 88 extend between the platens 86 and inner end portions 84C of the support arms 84 and apply a downward force on the platens 86 while permitting the platens 86 to move independently of one another toward and away from the support arms 84 and assume positions at a particular distance below the support arms 84 which will accommodate the number of items P stacked below the platens 86 within the compartments 46 of the respective columns 44 of the carousel 36 whereby the platens 86 will each continuously apply a hold down force on the stacked items P within the columns 44 as the items P are successively dispensed to below the lower plate 42 of the carousel 36 and into the dispensing passage 34D of the platform 34.

The latch device 82 of the hold down mechanism 12 includes a casing 90 fixedly connected to the ring-shaped member 80 in any suitable manner at a location spaced between a pair of the support arms 84. The casing 90 extends inwardly from the ring-shaped member 80 and about the upright shaft 76. The latch device 82 also includes a latching element 92 movably mounted within the casing 90 and latchable to the upright shaft 76 such that the casing 90 and the latching element 92 cooperate with one another to movably mount and releasably latch the ring-shaped member 80 in a cantilevered manner to the upright shaft 76.

More particularly, the casing 90 of the latch device 82 includes an outer portion 94 and an inner portion 96. The outer portion 94 of the casing 90 defines a hollow cavity 94A and an outer end opening 94B which communicates with the hollow cavity 94A. The inner portion 96 of the casing 90 has upper and lower openings 96A, 96B and a passageway 96C extending therebetween and communicating therewith and with the hollow cavity 94A. The casing 90 is disposed about the upright shaft 76 such that the shaft 76 extends vertically through the passageway 96C and the upper and lower openings 96A, 96B of the inner portion 96 of the casing 90.

The latching element 92 of the latch device 82 includes an elongated plunger 98 reciprocally mounted in the hollow cavity 94A of the outer portion 94 of the casing 90 for movement toward and away from the upright shaft 76 so as to be horizontally extendable across the passageway 96C of the inner portion 96 of the casing 90. The latching element 92 also includes a biasing spring 100 captured in the hollow cavity 94A of the outer portion 96 of the casing 90 between a portion of the casing 90 and the plunger 96 which causes it to normally be extended across the passageway 96C and into contact and engagement with the upright shaft 76. The latching element 92 further includes an elongated handle 102 fastened to an outer end 98A of the plunger 98 and extending radially outward therefrom relative to the vertical axis of the upright shaft and through the hollow cavity 94A of the outer portion 94 of the casing 90 and through the outer end opening 94B of the outer portion 94 to beyond the casing 90. The handle 102 has a knob 104 on an outer end of the handle 102 which can be grasped and pulled on by a user to manually overcome the inward biasing force of the spring 100 and move the plunger 98 away from the upright shaft 76. The plunger 98 has an arcuate shaped inner end 98B adapted to conform with the configuration of the outwardly-facing ratchet teeth 78 with which the inner end 98B of the plunger 98 makes contact when the handle 104 is released by a user.

The weight of (or downwardly directed force of gravity on) the hold down mechanism 12 is sufficient to overcome the inward biasing force of the spring 100 so as to cause the downwardly and outwardly sloping and arcuately-shaped upper surfaces 78A of the ratchet teeth 78 on the shaft 76 to act as cam surfaces upon which the arcuate-shaped inner end 98B of the plunger 98 will ride as a cam surface follower causing the plunger 98 to retract outwardly and clear the ratchet teeth 78 as the hold down mechanism 12 drops downward along the shaft 76 and columns 44 of the carousel 36 until its platens 86 engage with and come to rest upon the upper ones of the items P in the stacks S thereof. Due to the biasing force of the spring 100 being sufficiently low or the spring 100 being sufficiently "soft" relative to the weight of the hold down mechanism 12, the mechanism 12 when inserted upon the shaft 76 and in the upper end of the carousel 36 is capable of self-positioning itself upon the stacks S of items P merely by the user freeing and dropping the hold down mechanism 12 after its insertion.

The hold down mechanism 12 cannot be raised relative to and from the carousel 36 without positively pulling out on the handle 102 because the arcuate-shaped inner end 98A of the plunger 98 will underlie the horizontal lower surface 78C of a respective one of the ratchet teeth 78 and block upward movement of the hold down mechanism 12. However, the user can pull outward on the handle 102 so as to provide clearance between the plunger 98 and the ratchet teeth 78 to either install by lowering or remove by raising the hold down mechanism 12 into or from the carousel 36.

Figure 9:
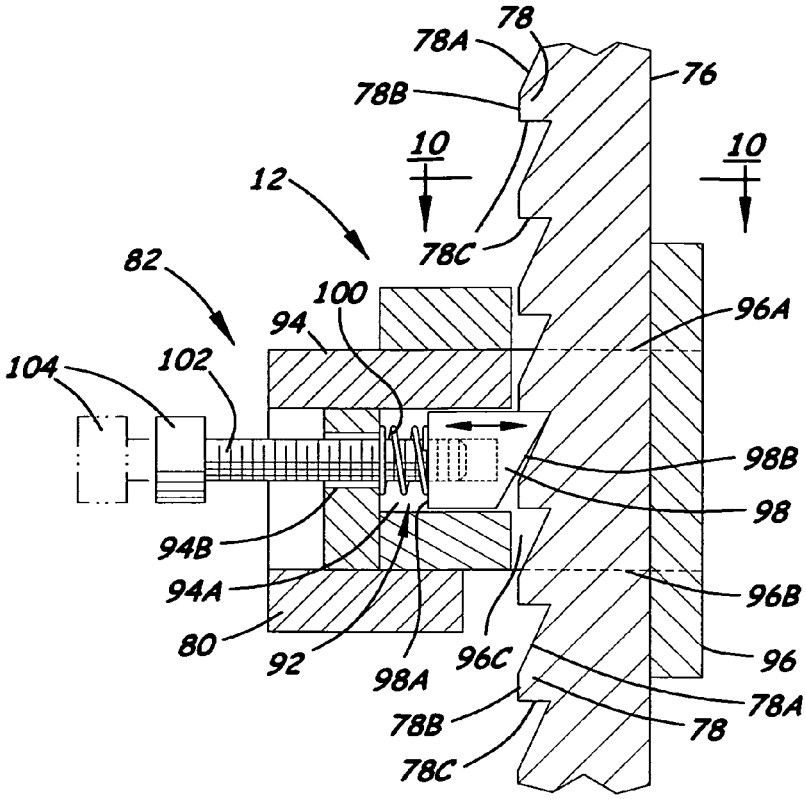
FIG. 9 is another enlarged fragmentary vertical sectional view of the hold down mechanism taken along line 9-9 of FIG. 7.
Figure 10:
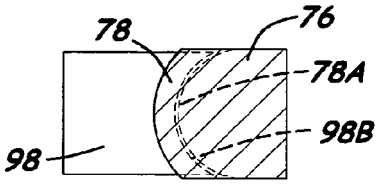
FIG. 10 is an enlarged fragmentary top plan view partly in section of the hold down mechanism taken along line 10-10 of FIG. 9.

To recap, the plunger 98 is movable between outward and inward positions, as seen in FIG. 9. In the outward position, as seen in dashed line form in FIG. 9, which the plunger 98 assumes when manually pulled away from the shaft 76 and the inner end 98B of the plunger 98 is removed from alignment vertically with the ratchet teeth 78, the hold down mechanism 12 is permitted to be manually lifted and undergo sliding movement along the shaft 76 past the ratchet teeth 78 toward the upper end 76B of the shaft 76 and separated from the carousel 36. In the inward position, as seen in solid line form in FIG. 9, which the plunger 98 assumes when it is manually released by the user, its inner end 98B is located adjacent to the shaft 76 and below the lower surface 78C of a respective one of the ratchet teeth 78 and above the upper cam surface 78A of the next lower one of the ratchet teeth 78. This position and the respective shapes of the upper and lower surfaces 78A, 78C of the ratchet teeth 78 permit sliding movement of the hold down mechanism 12 downward along the shaft 76 past the ratchet teeth 78 toward the lower end 76A of the shaft 76 due to gravity as the height of the stacks S decreases while preventing reverse sliding movement of the hold down mechanism 12 upward past the ratchet teeth 78 toward the upper end 76B of the shaft 76. This will preclude scattering and escape of the items P from stacked relationships within the columns 44 of the carousel 36 upon the occasion of the vending machine 10, and thus the carousel 36 and the hold down mechanism 12 therewith, being inverted from their intended upright operative position by a person or persons attempting to pilfer items from the machine or just attempting to damage the machine. In some instances, such as where the vending machine is unlikely to be inverted by vandals and the mechanism is made out of a heavy metal material, instead of a relatively light plastic, the ring and platens are of sufficient weight themselves to perform the hold down function without the need for mounting to the shaft 76. In those instances, the shaft 76 can be omitted.

It is thought that the present invention and its advantages will be understood from the foregoing description and it will be apparent that various changes may be made thereto without departing from the spirit and scope of the invention or sacrificing all of its material advantages, the form hereinbefore described being merely an exemplary embodiment thereto.

The invention claimed is:

1. A merchandise hold down mechanism for use in a vending machine, said mechanism comprising:

(a) an elongated upright shaft having a series of vertically spaced and outwardly projecting teeth defined thereon between lower and upper ends of said shaft;

(b) a ring-shaped member;

(c) a latch device fixedly cantilevered to said ring-shaped member and latchable to said upright shaft in cooperation with said teeth thereon so as to permit unassisted movement of said ring-shaped member and said latch device therewith downward along said shaft due to the influence of gravity on said ring-shaped member but not upwardly along said shaft due to manually lifting said ring-shaped member without first unlatching said latch device from said shaft, wherein said latch device includes a casing fixedly connected to said ring-shaped member at a location spaced between a pair of said support arms, said casing extending inwardly from said ring-shaped member and disposed about said shaft such that said shaft extends substantially vertically through said casing;

(d) a plurality of support arms equally spaced apart from one another and fixed to and extending inwardly from said ring-shaped member;

(e) a plurality of platens each independently of one another being movably and reciprocally mounted on and disposed below one of said support arms; and (f) a mechanically acting element made of yieldably resilient material mounted between said platens and said support arms for exerting a relatively weak downwardly directed force on each of said platens independently of other of said platens so as to bias a respective one of said platens to move downwardly away from a corresponding respective one of said support arms and against a top one of a plurality of items in a corresponding one of a plurality of stacks aligned with and under said plurality of platens while at the same time said element being yieldable to permit said platen to move upwardly toward said support arm to accommodate the stacks of items having different heights as items are successively dispensed from bottoms of successive stacks.

2. The mechanism of claim 1 wherein at least some of said teeth on said shaft have an upper surface sloping downwardly and outwardly relative to a vertical axis of said shaft and a lower surface extending substantially horizontally and orthogonally relative to said vertical axis such that said upper surface serves as a cam surface whereas said lower surface serves as a blocking surface.

3. The mechanism of claim 1 wherein said latch device also includes a latching element movably mounted within said casing and latchable to said shaft such that said casing and latching element cooperate with one another to movably mount and releasably latch said ring-shaped member in a cantilevered manner to said shaft.

4. The mechanism of claim 3 wherein said latching element includes a plunger reciprocally mounted in said casing for undergoing movement toward and away from said shaft and into and from latchable engagement with said shaft.

5. The mechanism of claim 4 wherein said latching element also includes a second mechanically acting element made of a yieldably resilient material captured in said casing and exerting an inwardly directed biasing force on said plunger causing said plunger to normally extend into said latchable engagement with said shaft.

6. The mechanism of claim 4 wherein said latching element further includes a handle fastened to an outer end of said plunger and extending radially outward therefrom relative to a vertical axis of said shaft and beyond said casing such that an outer end of said handle can be grasped and pulled by a user to manually overcome said inward biasing force of said second mechanically acting element and move said plunger away from and into disengagement with said shaft to thereby unlatch said latch device from said shaft and enable said ring-shaped member to be manually lifted upwardly relative to said shaft.

7. The mechanism of claim 4, wherein said at least some of said teeth on said shaft have an upper surface sloping downwardly and outwardly relative to a vertical axis of said shaft and a lower surface extending substantially horizontally and orthogonally relative to said vertical axis such that said upper surface serves as a cam surface whereas said lower surface serves as a blocking surface.

8. The mechanism of claim 7 wherein said plunger has an inner end configured to conform with said teeth on said shaft such that when said plunger is engaged with said teeth said inner end of said plunger underlies said upper surface and overlies said lower surface of spaced apart adjacent ones of said teeth so that the force of gravity acting down upon said hold down mechanism is sufficient to overcome said inward biasing force of said second mechanically acting element on said plunger that maintains said inner end of said plunger engaged with said adjacent teeth and causes said upper surface of said tooth above said inner end of said plunger to bear down and act as said cam surface upon said inner end of said plunger and said inner end of said plunger, in turn, to act as a cam surface follower relative to said cam surface causing said plunger to retract outwardly overcoming said inward biasing force of said second mechanically acting element and clear of said teeth as said hold down mechanism drops downward along said shaft until said platens engage with and come to rest upon upper ones of the items in the stacks thereof.

9. A merchandise hold down mechanism in combination with a carousel in a merchandise storing and dispensing head of a vending machine, said hold down mechanism comprising:

(a) a shaft adapted to be fixedly mounted upright upon a bottom plate of the carousel adjacent to a plurality of tubular receptacles adapted to contain stacks of items therein extending above the bottom plate of the carousel and being fixedly mounted in a circular arrangement and extending upright on the bottom plate of the carousel, said shaft having a series of vertically spaced and outwardly projecting ratchet teeth defined thereon between lower and upper ends of said shaft;

(b) a ring-shaped member adapted to extend exteriorly about said shaft and plurality of tubular receptacles;

(c) a latch device fixedly cantilevered to said ring-shaped member and latchable to said upright shaft in cooperation with said ratchet teeth thereon so as to permit unassisted movement of said latch device and said ring-shaped member therewith downward along said shaft but not upwardly along said shaft;

(d) a plurality of support arms equally spaced apart from one another and fixed to and extending inwardly from said ring-shaped member through outer substantially vertical slots in the tubular receptacles;

(e) a plurality of platens each independently of one another being movably and reciprocally mounted on and disposed below one of said support arms so as to extend downwardly within a corresponding one of the tubular receptacles; and (f) a spring mounted between said platens and said support arms for exerting a relatively weak downwardly directed force on each of said platens independently of other of said platens so as to bias a respective one of said platens to move downwardly away from a corresponding respective one of said support arms and against a top one of a plurality of items in a corresponding one of a plurality of stacks in the tubular receptacles aligned with and under said plurality of platens while being yieldable to permit said platen to move upwardly toward said support arm to accommodate the stacks of items having different heights as items are successively dispensed from the tubular receptacles at bottoms of successive stacks.

10. The mechanism of claim 9 wherein at least some of said teeth on said shaft have an upper surface sloping downwardly and outwardly relative to a vertical axis of said shaft, a lower surface extending substantially horizontally and orthogonally relative to said vertical axis, and a middle surface spaced from said vertical axis and extending substantially vertically relative to said vertical axis and interconnecting said upper and lower surfaces such that said upper surface serves as a cam surface whereas said lower surface serves as a blocking surface.

11. The mechanism of claim 9 wherein said latch device includes a casing fixedly connected to said ring-shaped member at a location spaced between a pair of said support arms, said casing extending inwardly from said ring-shaped member and disposed about said shaft, said casing having an outer portion and an inner portion, said outer portion defining a hollow cavity and an outer end opening which communicates with said hollow cavity, said inner portion having upper and lower openings and a passageway extending between and communicating with said upper and lower openings and with said hollow cavity such that said shaft extends substantially vertically through said passageway and said upper and lower openings of said inner portion of said casing.

12. The mechanism of claim 11 wherein said latch device also includes a latching element movably mounted within said casing and latchable to said shaft such that said casing and latching element cooperate with one another to movably mount and releasably latch said ring-shaped member in a cantilevered manner to said shaft.

13. The mechanism of claim 12 wherein said latching element includes a plunger reciprocally mounted in said hollow cavity of said outer portion of said casing for undergoing movement toward and away from said shaft so as to be substantially horizontally extendable across said passageway of said inner portion of said casing.

14. The mechanism of claim 13 wherein said latching element also includes a second spring made of a yieldably resilient material captured in said hollow cavity of said outer portion of said casing between a part thereof and said plunger so as to exert an inwardly directed biasing force on said plunger causing said plunger to normally extend across said passageway and into engagement with said shaft.

15. The mechanism of claim 14 wherein said latching element further includes a handle fastened to an outer end of said plunger and extending radially outward therefrom relative to said vertical axis of said shaft and through said hollow cavity and an outer end opening of said outer portion of said casing to beyond said casing such that an outer end of said handle can be grasped and pulled by a user to manually overcome said inward biasing force of said spring and move said plunger away from and into disengagement with said shaft to thereby unlatch said latch device from said shaft and enable said ring-shaped member to be manually lifted upwardly relative to said shaft.

16. The mechanism of claim 14, wherein said at least some of said teeth on said shaft have an upper surface sloping downwardly and outwardly relative to a vertical axis of said shaft, a lower surface extending substantially horizontally and orthogonally relative to said vertical axis, and a middle surface spaced from said vertical axis and extending substantially vertically relative to said vertical axis and interconnecting said upper and lower surfaces such that said upper surface serves as a cam surface whereas said lower surface serves as a blocking surface.

17. The mechanism of claim 16 wherein said plunger has an arcuate shaped inner end adapted to conform with said teeth on said shaft such that when said inner end of said plunger is engaged with said teeth said inner end underlies said upper surface and overlies said lower surface of spaced apart adjacent ones of said teeth so that the force of gravity acting down upon said hold down mechanism is sufficient to overcome said inward biasing force of said second spring on said plunger that maintains said inner end of said plunger engaged with said adjacent teeth and causes said upper surface of said tooth above said inner end of said plunger to bear down and act as a cam surface upon said inner end of said plunger and said inner end of said plunger, in turn, to act as a cam surface follower causing said plunger to retract outwardly and clear of said teeth as said hold down mechanism drops downward along said shaft until said platens engage with and come to rest upon upper ones of the items in the stacks thereof.

* * * * *